US006278429B1

(12) United States Patent
Ruth et al.

(10) Patent No.: US 6,278,429 B1
(45) Date of Patent: Aug. 21, 2001

(54) BISTABLE REFLECTIVE CHOLESTERIC LIQUID CRYSTAL DISPLAYS UTILIZING SUPER TWISTED NEMATIC DRIVER CHIPS

(75) Inventors: Jonathan C. Ruth, Kent, OH (US); Richard Hewitt, Beaverton, OR (US); Philip J. Bos, Hudson, OH (US)

(73) Assignee: Kent State University, Kent, OH (US)

( * ) Notice: Subject to any disclaimer, the term of this patent is extended or adjusted under 35 U.S.C. 154(b) by 0 days.

(21) Appl. No.: 09/151,420

(22) Filed: Sep. 11, 1998

(51) Int. Cl.[7] ..... G09G 3/36

(52) U.S. Cl. ..... 345/94; 345/208; 345/210; 349/96; 349/98

(58) Field of Search ..... 345/94, 95, 208, 345/210; 349/96, 98

(56) References Cited

U.S. PATENT DOCUMENTS

| | | | | |
|---|---|---|---|---|
| 5,570,216 | * | 10/1996 | Lu et al. | 359/101 |
| 5,748,277 | * | 5/1998 | Huang et al. | 345/210 |
| 5,933,203 | * | 8/1999 | Wu et al. | 349/35 |
| 5,942,154 | * | 8/1999 | Kim et al. | 349/115 |
| 5,995,180 | * | 11/1999 | Moriwaki et al. | 349/96 |
| 6,034,752 | * | 3/2000 | Khan et al. | 349/74 |
| 6,061,108 | * | 5/2000 | Anderson et al. | 349/98 |

OTHER PUBLICATIONS

J. Ruth, R. Hewitt, and P. Bos, *Low Cost Dynamic Drive Scheme For Reflective Bistable Cholesteric Liquid Crystal Displays*, pp. 89–94, Sep. 22–23, 1997, Flat Panel Display '97, Copyright by the Society For Information Display, Metropolitan Detroit Chapter.

* cited by examiner

*Primary Examiner*—Richard Hjerpe
*Assistant Examiner*—Kimnhung Nguyen
(74) *Attorney, Agent, or Firm*—Renner, Kenner, Greive, Bobak, Taylor & Weber

(57) ABSTRACT

A driving circuit for a reflective bistable cholesteric liquid crystal display which includes one substrate having a plurality of column or segment electrodes opposed by another substrate having a plurality of row or common electrodes. The intersecting column and row electrodes with the cholesteric material therebetween form a plurality of pixels. The driving circuit selectively applies a voltage to the row and column electrodes to control the appearance of the cholesteric material. In particular, the driving circuit includes at least one common driver coupled to respective common electrodes with each common driver having a first and a second common frame switch with corresponding high or low inputs. The first and second common frame switches are linked to one another by a common frame line. The high and low common inputs are connected to a plurality of common data switches, the first common frame switch a first and a second common voltage input and the second column frame switch having a third and a fourth common voltage input connected to each other. The driving circuit also includes at least one segment driver coupled to respective segment electrodes. The at least one segment driver is configured much the same as the common driver, except that it receives different input voltages. By selectively toggling the frame and data switches of each driver, a dynamic drive scheme can be applied to the display.

35 Claims, 7 Drawing Sheets

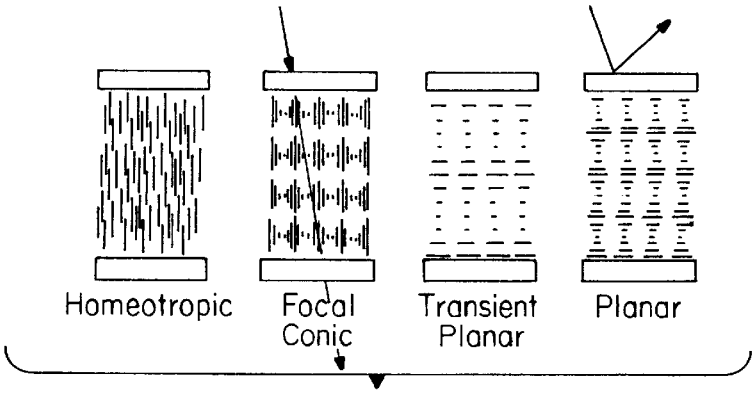
FIG.-1
FIG.-2A
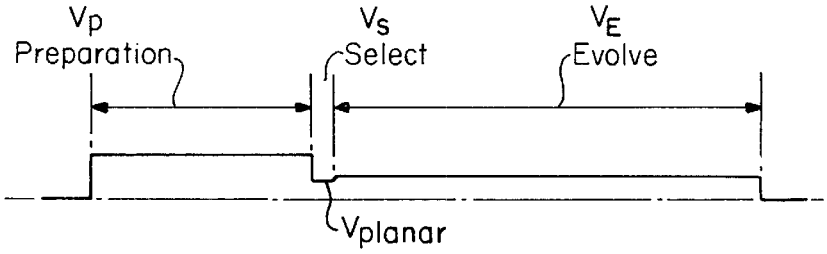
FIG.-2B
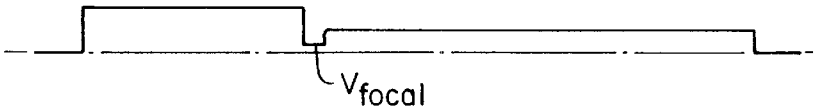
FIG.-3A
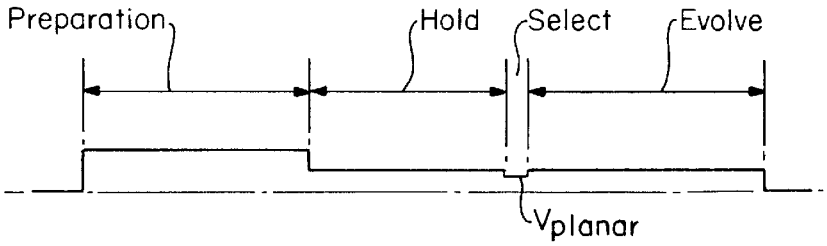
FIG.-3B
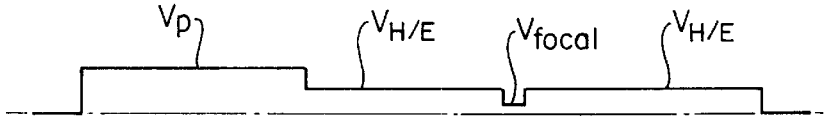

P= Planar
F= Focal Conic

BISTABLE REFLECTIVE CHOLESTERIC LIQUID CRYSTAL DISPLAYS UTILIZING SUPER TWISTED NEMATIC DRIVER CHIPS

GOVERNMENT RIGHTS

The United States Government has a paid-up license in this invention and may have the right in limited circumstances to require the patent owner to license others on reasonable terms as provided for by the terms of Contract No. N61331-94K-0042, awarded by the Defense Advanced Research Projects Agency.

TECHNICAL FIELD

This invention relates to the operation of liquid crystal displays. In particular, the present invention relates to a driving circuit for operating a cholesteric liquid crystal display. Specifically, the present invention relates to a driving circuit employing specially modified drivers that are normally used in super twisted nematic liquid crystal displays.

BACKGROUND ART

Cholesteric liquid crystal materials are known and disclosed in U.S. Pat. Nos. 5,437,811; 5,695,682; 5,453,863; and 5,691,795, all of which are assigned to the assignee of the present invention and which are incorporated herein by reference. The primary advantage of the bistable cholesteric liquid crystal materials disclosed in these patents is that they can be driven to a desired texture with application of a voltage and remain in that texture after removal of the applied voltage. As seen in FIG. 1, bistable cholesteric liquid crystal materials are known to exhibit at least four states or textures: homeotropic, focal conic, transient planar, and planar. Both the homeotropic and transient planar textures are considered transitory and do not remain after removal of an electric field. These transitory textures are employed to facilitate the transformation of the cholesteric liquid crystal material into either a weakly light scattering, transmissive focal conic texture or a reflective planar texture.

The next step in the development of bistable cholesteric liquid crystal devices was focused on how to drive the cholesteric liquid crystal material quickly between the focal conic and planar textures. This development is necessitated by the desire to provide efficient operation of the device, with as fast as possible update rates. Such driving schemes are found in U.S. Pat. No. 5,748,277, and in U.S. patent application Ser. No. 08/852,319, both of which are owned by the assignee of the present invention and which are incorporated herein by reference. Initially, a three phase dynamic drive scheme, as shown in FIGS. 2A and 2B, was employed to control the appearance of the cholesteric device. As is discussed in the above patents, the liquid crystal material is disposed between two substrates, one of which has a plurality of row electrodes and the other which has a plurality of column electrodes orthogonal to the row electrodes. Application of voltage waveforms to the electrodes is multiplexed or applied in a predetermined sequence. Hence, these displays are sometimes referred to as multiplexed displays. Those skilled in the art will appreciate that multiplexed displays are not limited to "row and column" electrode patterns. Segmented liquid crystal displays, such as clock faces and calculator displays, may also be multiplexed. In either type of display the term "common electrode" may be used to refer unto a row electrode, and the term "segment electrode" may be used to refer to a column electrode.

The liquid crystal material in between the intersecting electrodes form a pixel. As shown in FIGS. 2A and 2B, the appearance of each pixel is controlled by a pixel voltage waveform which comprises a sequence of three RMS voltages: $V_{preparation}$, $V_{select/non\text{-}select}$, and $V_{evolve}$. $V_{preparation}$ or $V_p$ drives the cholesteric liquid crystal material into the homeotropic texture regardless of its initial texture. Application of $V_{select/non\text{-}select}$ or $V_{s/ns}$ determines if the homeotropic texture relaxes into the planar ($V_{select}$) or the focal conic texture ($V_{non\text{-}select}$). The evolution voltage or $V_e$ serves two functions. First, it permits the focal conic texture to evolve from the transient planar texture that results from applying $V_{non\text{-}select}$. The evolution voltage also restores and maintains the homeotropic texture after $V_{select}$ is applied allowing relaxation to the planar texture which occurs when $V_{evolve}$ is removed. It has been determined that display update speed can be increased by applying the voltages $V_{preparation}$ and $V_{evolve}$ across many rows simultaneously. Once $V_{evolve}$ is removed from the last addressed row, all power is removed from the display and the desired indicia appears on the display.

Implementation of such a drive scheme has proven to be quite costly. In particular, previous displays required 50–60V (RMS) to drive the cholesteric liquid crystal material into the homeotropic texture from which it relaxes into the reflective planar texture. Since the use of cholesteric liquid crystal materials in displays is relatively new, there are no commercially available electronic driving circuits uniquely designed to apply the necessary voltage waveforms to a display.

One option that was initially investigated was to employ a multiplexed super twisted nematic (STN) display driver. STN displays are addressed constantly so that each pixel always has an applied voltage across it that is the combination of waveforms being applied to the appropriate intersecting electrodes. The "state" or texture of a particular pixel (on or off, light or dark) depends on the average voltage across the pixel during a single scan or update of the display. The difference between the average voltages of these two pixels states is small, on the order of about 0.1 volt. This difference is generated entirely by the choice of voltage, either high or low, applied to the pixel while it is selected for update. The number of DC voltage levels required to drive a STN display is relatively small. Four voltage levels are required for each common/row and segment/column waveform and typically, two of these voltage levels are common to both. Accordingly, only six distinct DC voltage levels, which are separate from the logic voltage inputs, are required to address an STN display. STN driver chips also include a data input called the frame line that selects between two fixed pairs of display voltage inputs for all the outputs on a chip. For example, if the display voltage inputs are labeled $V_1$, $V_2$, $V_3$, and $V_4$, the frame line can select between either the pair $V_1$ and $V_2$ or the pair $V_3$ and $V_4$. No other selections are possible. Of course other label designations could be used for the voltage inputs. Each STN driver chip also includes a shift register containing one data bit per chip output. Each bit selects one of the two display voltage inputs selected by the frame line. Accordingly, each bit can select between $V_1$ and $V_2$ or between $V_3$ and $V_4$. Once again, no other selections are possible. The voltages applied to the display voltage inputs must obey strict rules. At a minimum, the rule ($V_4 \geqq V_3 \geqq V_2 \geqq V_1$) must be obeyed. Moreover, it is typical to require two of the four display voltage inputs ($V_3$ and $V_4$) to be set very near to the chip's upper supply voltage while the other two display voltage inputs ($V_1$ and $V_2$) are set very near the chip's lower supply voltage. These requirements are intended to ensure proper chip operation and are primarily a function of the chip design.

Although it was desired to employ the STN driver chips to drive the cholesteric liquid crystal display because of their relatively low cost (about 2 cents per output), it was readily apparent that the drive scheme requirements of cholesteric liquid crystal displays were significantly more severe than super twisted nematic displays. The state of a STN pixel depends only on the average voltage across the pixel during a single update of the display and not on the specific sequence of voltages applied to the pixel. While cholesteric liquid crystal displays respond to the average voltages applied to them, the state of a pixel depends on the sequence of RMS/average voltages applied during an update. As noted previously, the dynamic address scheme requires the proper application of RMS voltages $V_p$, $V_{s/ns}$, and $V_e$ in order to select between the two stable cholesteric liquid crystal textures. The only known way to address cholesteric liquid crystal displays with the dynamic drive scheme was to employ high voltage analog switches to generate the necessary row waveforms.

A first attempt at employing STN drivers resulted in providing half of the signals needed to drive a cholesteric liquid crystal display. In this approach, the STN driver chips were employed to generate the column waveforms and high voltage analog switches were employed to generate the row waveforms. The row waveforms were AC waveforms, and the necessary RMS voltages were generated entirely by these row waveforms. The column waveforms supplied by the segment/column drivers were of small amplitude and amounted to inconsequential noise on all rows except the row being addressed. On the row being addressed, the row waveform voltage levels were comparable to the column waveform (data) voltage levels. As such, the proper select and non-select voltages could be generated by changing the phase of the column waveforms.

The fundamental characteristic of STN driver chips that led to this hybrid mixture of driver chips and analog switches is that STN driver chips are "unipolar," that is, the output voltages can range, for example, from 0–40 volts, as opposed to "bipolar" wherein the output voltages would range from −40V to +40V. It was not thought possible to generate the necessary RMS voltages given the limited voltage range of STN drivers, typically no more than 40 volts, versus the 200 volts required for the analog switches used in the initial embodiment. In particular, the initial embodiment was designed so that one high voltage analog switch chip was needed to drive every two rows. At eight switches per chip, four separate analog switches controlled each row. Accordingly, a four inch by four inch display used in the initial embodiment had 320 rows, so 160 of the high voltage analog switch chips were required. This forced the cost of the drivers alone to over $3,000.00. Although the drivers in association with the other circuitry were effective in driving the display, it was quite cost prohibitive. Moreover, scaling up to a page-size display at a reasonable resolution (133 DPI) was clearly out of the question in attempting to develop a commercially cost-effective cholesteric display.

DISCLOSURE OF INVENTION

It is thus an object of the present invention to provide a low-cost dynamic drive circuit for multiplexing a bistable reflective cholesteric liquid crystal display using drivers originally designed for super twisted nematic displays.

It is another object of the present invention to provide a drive circuit which employs up to 8 different voltage levels which can range anywhere from 0 to 80 volts.

It is a further object of the present invention to provide a multiplexing drive circuit and method for use, as above, in which common and segment drivers are coupled to corresponding common and segment electrodes which are employed to drive the liquid crystal material disposed between a pair of substrates.

It is yet another object of the present invention to provide the drive circuit and method for use, as above, in which each common and segment driver contains at least two frame switches, each of which has a high and low input which receives voltage waveforms that are transferred to a plurality of data switches which in turn are coupled to respective electrodes.

It is yet another object of the present invention to provide the drive circuit and method for use, as above, in which a frame line is employed to toggle the frame switches in each of the drivers to select a voltage input pair which can be applied to the display.

It is still another object of the present invention to provide the drive circuit and method for use, as above, in which at least one of the frame switches in the common and segment drivers has two of its inputs connected to one another, thereby allowing an arbitrary waveform to be submitted to the corresponding electrodes.

It is still a further object of the present invention to provide the drive circuit and method for use, as above, in which each common and segment driver has a plurality of data switches which direct one of the frame switch outputs to the appropriate electrodes.

It is an additional object of the present invention to provide a driving circuit and method for use, as above, in which one of the row frame switches receives three different voltage values so that the indicia appearing on the display appears row by row.

It is still yet another object of the present invention to provide a driving circuit and method for use, as above, in which one of the row frame switches receives two different voltage values so that the indicia appearing on the display appears all at once.

The foregoing and other objects of the present invention, which shall become apparent as the detailed description proceeds, are achieved by a bistable cholesteric liquid crystal display, comprising a pair of opposed substrates, one substrate having a first plurality of electrodes, the other substrate having a second plurality of electrodes oriented in a direction different than the first plurality of electrodes, a cholesteric liquid crystal material disposed between the pair of opposed substrates and forming a pixel at each intersection of the first and second plurality of electrodes, a first super twisted nematic driver having a plurality of outputs connected to the first plurality of electrodes, and a second super twisted nematic driver having a plurality of outputs connected to second plurality of electrodes, wherein both the drivers receive a plurality of voltage input waveforms for selective transmission to first and second plurality of electrodes.

Other aspects of the present invention are attained by a method for addressing a bistable cholesteric liquid crystal display which has a pair of opposed substrates, one of the substrates having a first plurality of electrodes, the other substrate having a second plurality of electrodes oriented in a direction different than the first plurality of electrodes, the substrates having cholesteric liquid crystal material disposed therebetween to form a pixel at each intersection of the first and the second plurality of electrodes, the first plurality of electrodes having at least a first driver coupled thereto and the second plurality of electrodes having at least a second driver coupled thereto, the method comprising the steps of applying a plurality of voltage input waveforms to the first driver and the second driver, wherein the voltage input waveforms are 50 volts or less, selectively transmitting the plurality of voltage input waveforms through the first and the second drivers to generate respective first and second output waveforms, and combining the first and second output waveforms at the intersecting electrodes to generate a pixel waveform that drives the cholesteric liquid crystal material to the desired appearance.

Still other aspects of the present invention are attained by a driving circuit for a reflective bistable cholesteric liquid crystal display which includes one substrate having a first plurality of electrodes opposed by another substrate having a second plurality of electrodes, wherein the intersection of the first and the second plurality of electrodes with cholesteric liquid crystal material disposed therebetween form a plurality of pixels, the driving circuit selectively applying voltages to the first and the second plurality of electrodes to control the appearance of each pixel, the driving circuit comprising at least one common driver coupled to the first plurality of electrodes, each common driver having a first and a second common frame switch, each common frame switch having a high input and a low input, first and second frame switches linked to one another by a common frame line, the frame switch outputs connected to a plurality of common data switches, each common data switch having an output, the first common frame switch receiving a first and a second common voltage input and the second common frame switch receiving a third and a fourth common voltage input connected to each other, wherein the common frame line is toggled to selectively pass through the common voltage inputs for use as the common voltage output from each common data switch, and at least one segment driver coupled to the second plurality of electrodes, at least one segment driver having a plurality of segment voltage outputs which are selectively applied to the second plurality of electrodes to drive the cholesteric liquid crystal material to a desired texture.

Yet other aspects of the present invention are attained by a method for addressing a liquid crystal display having a plurality of common electrodes oriented differently with respect to a plurality of segment electrodes with cholesteric liquid crystal material disposed therebetween, the method comprising the steps of connecting at least one common driver to the plurality of common electrodes, connecting at least one segment driver to the plurality of segment electrodes, and toggling a pair of frame switches in each common and segment driver such that a first of the pair of frame switches applies one of two waveforms to the corresponding electrodes or such that a second of the pair of frame switches applies an arbitrary waveform to the corresponding electrodes.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein:

FIG. 1 is a schematic representation of the various textures of a cholesteric liquid crystal as they appear in a display;

FIGS. 2A and 2B are exemplary dynamic drive voltage sequences for driving cholesteric liquid crystal material to either a focal conic or planar texture;

FIGS. 3A and 3B are four phase dynamic drive schemes of the present invention;

BEST MODE FOR CARRYING OUT THE INVENTION

Figure 4:
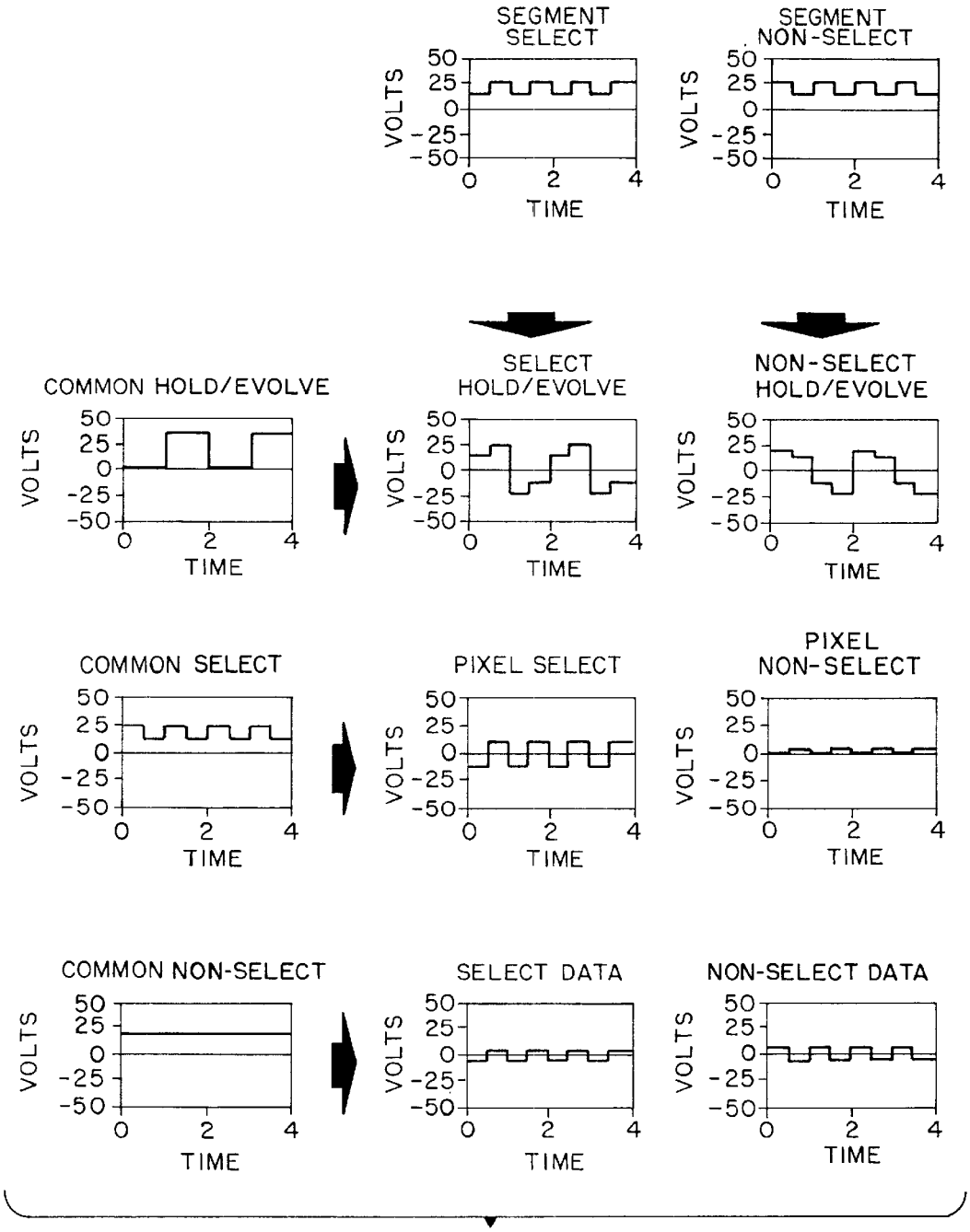
FIG. 4 illustrates the unipolar component waveforms of the dynamic drive scheme that are applied in each mode of the present invention without showing the row and column preparation waveforms which are simply square waves running rail to rail.

The present invention is employed with cholesteric liquid crystal displays which in and of themselves are quite simple to manufacture. These displays are typically opposed substrates of either glass or plastic. Patterned indium tin oxide electrodes are disposed on one substrate as common/row electrodes and are disposed on the other substrate as segment/column electrodes. The common and segment electrodes are positioned in different directions with respect to one another to form pixels which can be individually addressed by applying voltages to both. The indium tin oxide is usually overlaid with a barrier coat and an alignment layer. Spacing between the substrates is typically between 4 $\mu$m to 5 $\mu$m. Commercially available materials and standard fabrication techniques are employed to manufacture the displays.

As noted in the Background Art, cholesteric displays are typically driven into the homeotropic texture by applying bipolar waveforms, average value of about 50–60 $V_{RMS}$, to a plurality of rows with high voltage electronics. Given the unipolar output range of super twisted nematic driver chips (nominally 0–40 volts), it was evident that the dynamic drive scheme would need to be revised to a differential drive scheme. In other words, the necessary large RMS voltages can only be generated across the display by proper combination of large amplitude row and large amplitude column waveforms. Moreover, the display design had to be modified to lower the maximum RMS voltage required to drive the display into the homeotropic texture to about 40 volts. Yet another limitation of STN driver chips is that their logic allows only two of the four display voltage inputs to be applied to a display at one time by a single driver chip. Accordingly, the dynamic drive scheme shown in FIGS. 2A and 2B needed to be modified to "fit" onto the common/row driver chips by breaking it into two parts. The first part of this modified dynamic drive scheme applied $V_{preparation}$ to all pixels in all rows simultaneously, driving the entire display into the homeotropic texture. The second part begins by applying a "holding" voltage (whose value is less than $V_{preparation}$) to all pixels not being addressed in order to maintain their homeotropic textures until those pixels can be addressed. This "break up" of the dynamic drive scheme is implemented by having the common driver chips function in one of three operating modes while requiring the segment driver chips to function in one of two additional operating modes.

The most significant consequence of breaking up the original dynamic drive scheme is the addition of a new application voltage to the RMS pixel waveform in order to "hold" the cholesteric liquid crystal material in the homeotropic texture after applying the preparation voltage $V_p$. As seen in FIGS. 3A and 3B, the evolution voltage is now provided along with a holding voltage which is designated as $V_{h/e}$. Accordingly, a pixel sees a voltage waveform that produces a sequence of four RMS voltages, $V_{preparation}$, $V_{hold}$, $V_{select/non\text{-}select}$, and $V_{evolve}$. $V_{hold}$ is a voltage value that is applied to a pixel in the homeotropic texture prior to it being addressed with $V_{select/non\text{-}select}$. In other words, a pixel waveform is the resulting waveform produced at any pixel by combining output waveforms at the respective electrodes. All other RMS voltages shown in FIGS. 3A and B serve the same function as they did for the original dynamic drive scheme. All of the voltage values associated with the drive scheme are dependent upon the particular cholesteric material used and the design of the display. As such, any voltage value discussed herein is exemplary and not meant to be limiting.

Figure 5A:
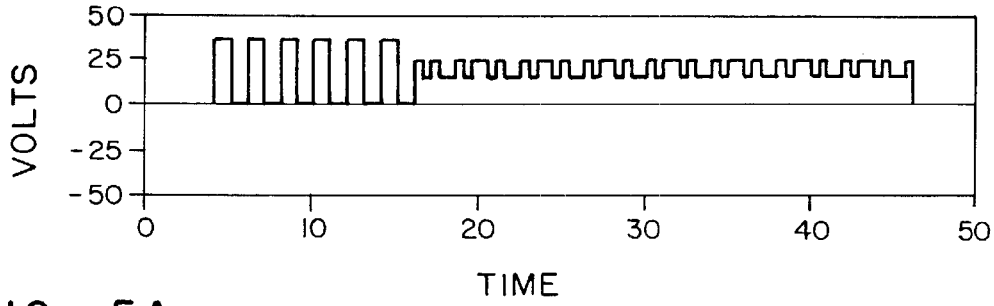
FIGS. 5A–C illustrate the combination of the component waveforms of FIG. 4 to show the typical column, row, and pixel waveforms, respectively, employed in the present invention.
Figure 5B:
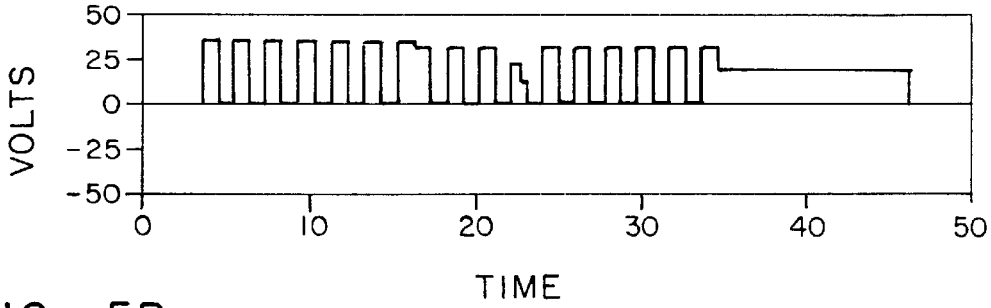
Figure 5C:
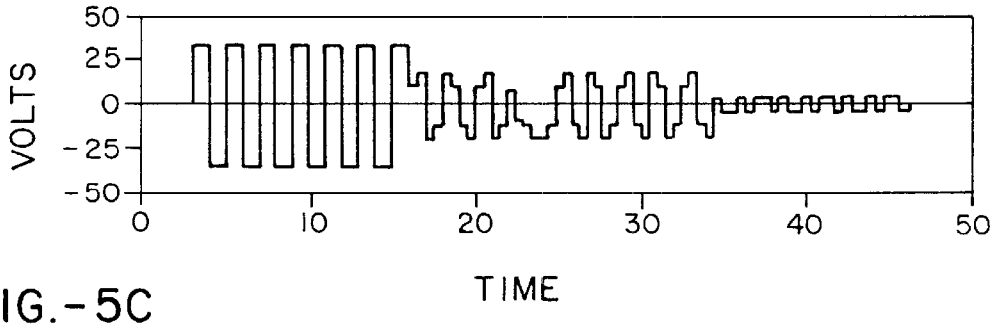

The drive scheme of the present invention requires the common driver chips to function in one of three operating modes and the segment driver chips to function in one of two additional operating modes as seen in FIG. 4. In each operating mode, the driver chips apply different monopolar component output waveform combinations to the display electrodes. The common and segment input preparation waveforms are simply square waves running rail to rail and are not shown. The two segment operating waveforms are segment select and segment non-select. The three common input operating waveforms are common hold/evolve, common select, and common non-select. Those skilled in the art will appreciate that the RMS value of the hold/evolve and data waveforms provided to the pixel are properly independent of the segment waveforms. Combination of the input waveforms shown in FIG. 4 generate the segment output waveform shown in FIG. 5A, the common output waveform shown in FIG. 5B, and the pixel waveform shown in FIG. 5C. The pixel waveform is a result of the difference between the common and segment waveforms. Accordingly, the pixel is prepared, held, written to, evolved, and then turned off, whereupon the desired appearance of the pixel is displayed.

Figure 6:
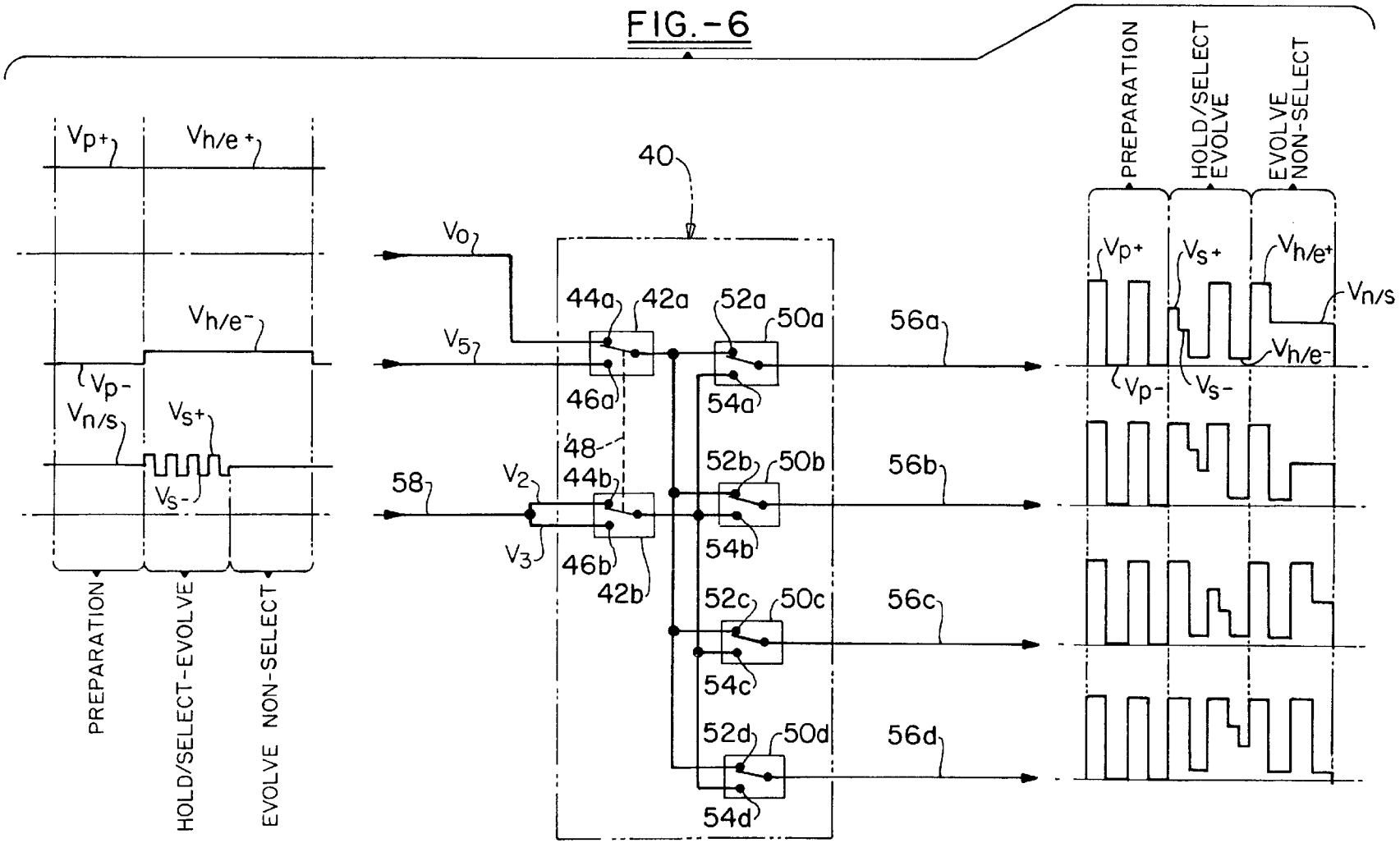
FIG. 6 is a block diagram for a common driver employed in a driving circuit of the present invention in which a scan mode is employed.
Figure 7:
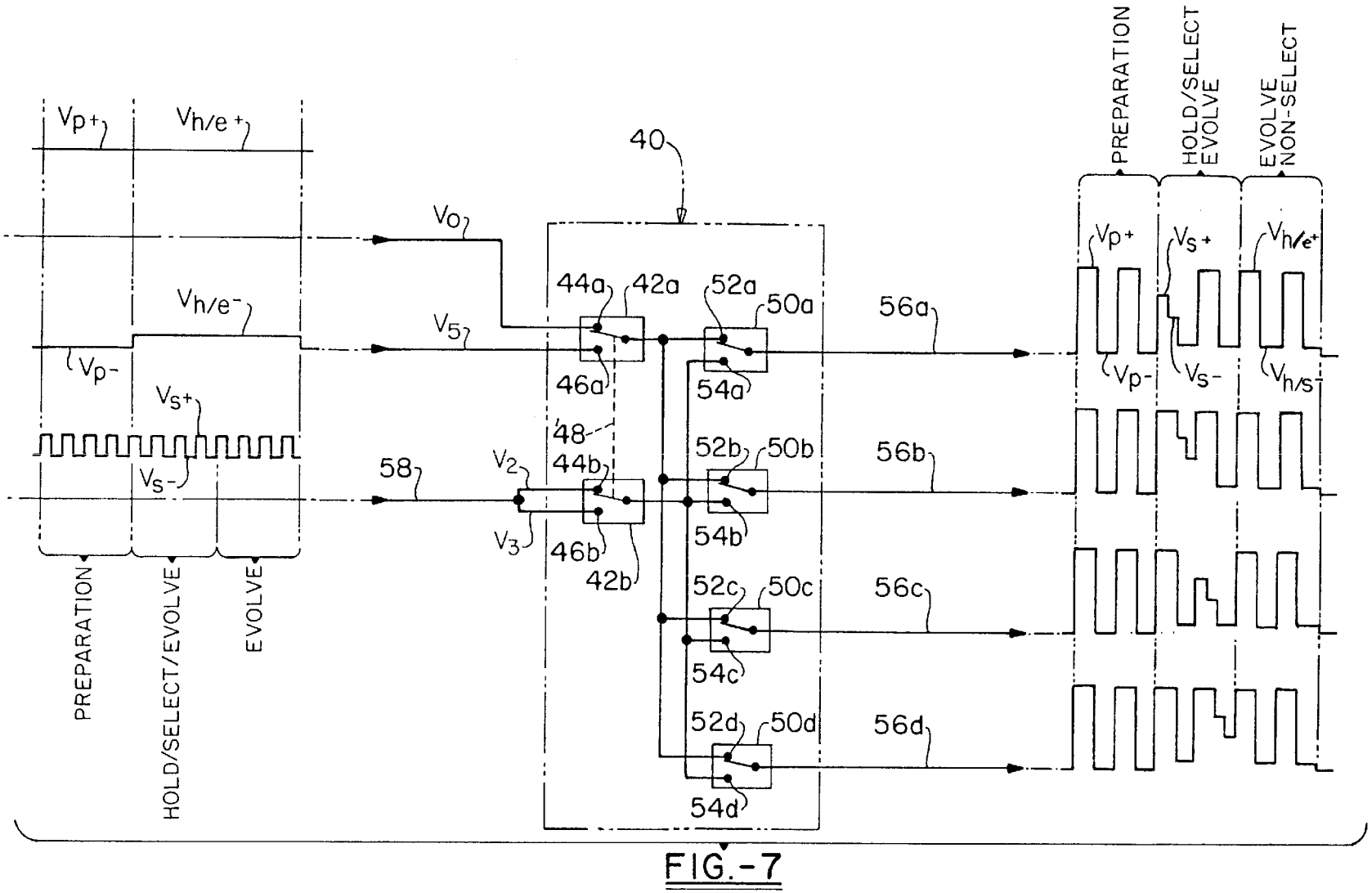
FIG. 7 is a block diagram for a common driver employed in a driving circuit of the present invention in which a flash mode is employed.
Figure 8:
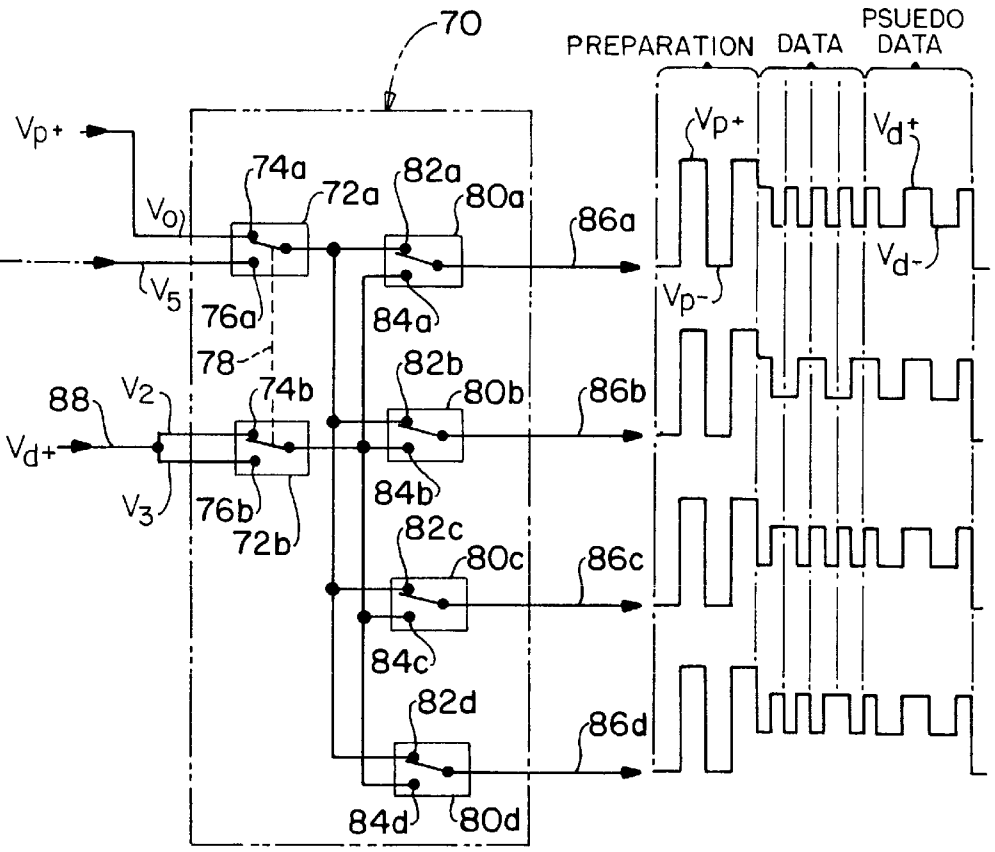
FIG. 8 is a block diagram for a segment driver employed in a driving circuit of the present invention.

Referring now to FIGS. 6–8, implementation of the input, output and resulting pixel waveforms for cholesteric displays is accomplished by using standard, off-the-shelf, low cost super twisted nematic drivers. FIGS. 6–8 are simply graphical representations of the functionality of the driver chips for selectively transmitting input waveforms (shown to the left of the chip) to obtain the desired output waveforms (shown to the right of the chip). The output waveforms from row/column driver(s) and the column/segment drivers are then combined at the pixel to form the pixel waveforms. The drivers shown herein are not meant to be an accurate representation the internal design or construction of an STN driver. Rather, these block diagrams are meant to be a representation of the logic of the driver showing how the driver's display voltage inputs can be routed to the driver's outputs. As such, the "switches" drawn in the figure are not real, physical switches, but they do represent the functionality of the circuitry of the driver.

In FIG. 6, a common driver according to the present invention is generally indicated by the numeral 40. As shown, the driver 40 can be thought of as an analog multiplexer with four voltage inputs and anywhere from 80 to 160 outputs. For simplicity sake, only four outputs are shown in the drawing. In FIG. 6, the common driver 40 has four inputs which are arbitrarily designated as $V_0$, $V_5$, $V_2$, and $V_3$.

The common driver 40 includes a pair of frame switches 42 wherein each frame switch has an alphabetic suffix. As such, the common driver 40 has a frame switch 42*a* and a frame switch 42*b*. Each frame switch 42 incorporates a high input 44 and a low input 46. As such, the frame switch 42*a* has a high input 44*a* and a low input 46*a*. The frame switches 42*a* and 42*b* are coupled to one another by a frame line 48 which is ultimately controlled by a digital control circuit (not shown) that may include a microprocessor. It will be appreciated that the digital control circuit associated with the driver chips contains the necessary hardware, software and memory to fully implement the objects of the present invention.

Connected to the outputs of each frame switch 42 are a plurality of data switches 50, each of which has an alphabetic suffix. Each data switch 50 has a high input 52 and a low input 54, both of which have a corresponding alphabetic suffix. Selection of the high input 52*a* or low input 54*a* is controlled by a data shift register within the driver and the data shift register is ultimately controlled by the digital control circuit. Depending upon the input voltages, the toggling of the frame line 48 and the data bits controlling the data switches 50, a data output 56 with a corresponding alphabetic suffix is generated by each data switch.

A modification to the common driver 40, which allows implementation of the dynamic drive scheme, is attained by electrically connecting the voltage inputs $V_2$ and $V_3$ of frame switch 42*b* to one another to form a super input 58. The super input 58 allows an arbitrary waveform that conforms to the display voltage input rules mentioned in the Background Art to be piped to a single output or to multiple outputs of the common driver 40 while the other outputs of the driver 40 swing rail to rail as the frame line 48 is toggled. If the receiving data switch 50 is set to a high input 52, the data output 56 will be either voltage input $V_0$ or $V_5$, depending upon the state of the frame line 48. If the receiving data switch 50 is set to the low input 54, the data output will be the arbitrary waveform applied to the super input 58, regardless of the state of the frame line 48.

The common driver 40 presented in FIG. 6 is employed in a "scan mode" that updates the display row by row. The particulars of this mode are discussed below. In order to implement this mode, three different voltage values ($V_{n/s}$, $V_{s+}$, $V_{s-}$) must be supplied to the super input 58.

Referring now to FIG. 7, it can be seen that the common driver 40 may also receive a 2-level select waveform at the superinput 58. This allows for a "flash mode update" wherein the entire image appears on the display all at once. The superinput 58 receives either a voltage value of $V_s$+ or $V_s$− during the selection phase. The particular aspects of this mode are also discussed below. In all other respects, the common driver shown in FIG. 7 is substantially the same as the common driver shown in FIG. 6.

Referring now to FIG. 8, a segment driver designated generally by the numeral 70, is presented. The segment driver 70 is employed in either the scan mode or the flash mode. While the row or common electrodes apply the majority of the pixel waveform, the segment or column output waveforms supply the data that combines with the row select waveform during the select phase to apply a high or low selection voltage value to the pixel. Accordingly, the cholesteric liquid crystal material is driven to the texture corresponding to the high or low selection data voltage.

The segment driver 70, much like the common driver 40, includes frame switches 72*a* and 72*b*, each of which has a high input 74 and a low input 76 with corresponding alphabetic suffixes. The frame switches 72*a* and 72*b* are coupled to one another by a frame line 78. Receiving the output generated by the frame switches 72 are data switches 80, each of which has an alphabetic suffix. The data switches 80 each have a high input 82 and a low input 84, wherein each output 86 has a corresponding alphabetic suffix. As with the common drivers, the segment driver 70 contains a data shift register that controls the selection of the high input 82 or the low input 84 of the data switches 80. Toggling of the frame line 78 and setting of the data switches 80 is ultimately controlled by the digital control circuit. The voltage input $V_O$ receives preparation voltage $V_p$+ while voltage input $V_5$ receives preparation voltage $V_p$− or data voltage $V_d$−. Inputs $V_2$ and $V_3$ are electrically connected to form superinput 88 that receives data voltage $V_d$+. The digital control circuit associated with the driving circuit sequences application of the various segment waveforms in much the same manner as the common waveforms. As seen in the resulting segment waveforms for the corresponding outputs of the data switches 80, the preparation voltages are applied during the preparation phase while the data voltages are applied thereafter. Accordingly, depending upon whether the data voltage applied is $V_d$− or $V_d$+, simultaneous with the application of the selection voltages to the row electrodes, the resulting planar or focal conic textures are obtained.

The digital control circuit controls the sequencing of the common and segment drivers to obtain the desired image appearance. As seen in FIGS. 6–8, the digital control circuit controls the drivers 40 and 70 to simultaneously apply the preparation voltages during a first phase, the hold/select/evolve and data voltages during a second phase and the evolve, non-select and pseudo data voltages during a third phase.

It must be stated at this time that the only way for all pixels in all rows of a bistable cholesteric display to be properly prepared (driven into the homeotropic texture) is for those pixels to be driven into the homeotropic texture simultaneously. This simultaneity is mandated by the differential nature of the revised dynamic drive scheme and the SIN driver logic.

The only way to generate the necessary large RMS voltages of the preparation phase of the pixel waveform is for the segment driver 70 to apply the segment preparation waveform to the segment electrodes while the common driver 40 applies the common preparation waveform to the common electrodes. Once the segment driver 70 begins applying the data waveforms to the segment electrodes, the preparation phase of the pixel waveform is no longer generated even if the common driver 40 still applies the common preparation waveform to the common electrodes. Likewise, if the common driver 40 begins applying the hold/evolve waveform, the select waveform, or the non-select waveform, the preparation phase of the pixel waveform is no longer generated even if the segment driver 70 still applies the segment preparation waveform.

The logic of the STN common driver prevents the simultaneous output of the common preparation waveform and any other common output waveform on a single driver.

Consequently, in order to generate properly the preparation phase of the pixel waveform, all segment driver outputs must apply the segment preparation waveform to the segment electrodes while all common driver outputs are applying the common preparation waveform to the common electrodes. This requirement holds regardless of the number of common or segment STN drivers connected to a bistable cholesteric liquid crystal display.

The common driver 40 initially controls application of the preparation phase by setting the data switches 50 to the high input to receive the preparation voltage $V_p$+ or $V_p$−. As best seen in the common or row output waveforms, the preparation section shows application of $V_p$+ or $V_p$−. This is accomplished by toggling frame switch 42*a* between its high and low inputs, with all the data switches 50 toggled to their high input 52. During this phase, the segment driver 70 outputs $V_{p-}$or $V_{p+}$, to the segment or column electrodes. As a result, the difference between the intersecting common and segment electrodes is applied to the pixel. In particular, the frame switch 72 is toggled between the high input 74 and the low input 76, with all the data switches 80 toggled to their high input 82.

In the hold/select/evolve section of the common or row output waveforms, it can be seen that initially row 0 receives one cycle of $V_s$+ and $V_s$− from the superinput 58 by virtue of the data switch 50*a* being toggled to the low input 54*a*. Simultaneously, all other data switches are toggled to their respective high inputs 52 to receive either $V_{h/e+}$ or $Vb_{h/e-}$ depending upon toggling of the frame line 48 that places the frame switch 42*a* at either the high input 44*a* or the low input 46*a*. Once the application of the selection voltage is complete for row 0, the data switch 50*a* is then set to the high input 52*a* so that the evolution phase may begin. Upon completion of the application of the selection voltage to row 0, data switch 50*b* is set to the low input 54*b* to apply $V_{s+}$ and $V_{s-}$ for one cycle to row 1. The above process is then repeated to complete the hold/select/evolve section of the waveform for row 1 and the remaining rows. During this phase, the segment driver 70 outputs $V_{d-}$ or $V_{d+}$ to the segment or column electrodes. In particular, the data switches 80 are toggled between their high inputs 82 and low inputs 84, as selectively determined by the digital control circuit, to apply either $V_{d+}$ and $V_{d-}$ in the appropriate sequence to the columns 0–4 during application of $V_{s+}$ and $V_{s-}$ by the common driver 40 to obtain the desired appearance of all pixels in the row being addressed.

Upon completion of the hold/select/evolve phase, frame switches 42 are toggled between high inputs 44 and low inputs 46 for a predetermined period for application of $V_{h/e}$, whereupon data switches 50 are toggled to a low input and $V_{n/s}$ is applied to the rows in the scan mode. Shortly after voltage $V_{n/s}$ is applied, all pixels in the row display the desired texture. As can be seen in row 1 of the output waveforms, the application of $V_s$+ and $V_s$− is one segment cycle and one-half common cycle removed from the application of $V_{s+}$ and $V_{s-}$ in the row 0 output. Likewise, the application of $V_{s+}$ and $V_{s-}$ in the outputs of rows 2 and 3 are removed from the preceding row by the same amounts during the hold/select/evolve phases.

One requirement of any liquid crystal display drive scheme is that the time-averaged voltage on every pixel be about 0 when averaged over some number of image updates. If the time average voltage across a pixel is not 0, ions in the liquid crystal material will migrate toward the electrodes. This ion migration will screen the voltage appearing on the pixel's electrodes, reduce the effective voltage across the pixel and change the switching properties of the pixel. Additionally, the electrodes can be permanently damaged if the migrating ions reach the electrodes. These changes are usually observed as image retention from one display update to the next. The dynamic drive scheme employed by the driving circuit of the present invention accomplishes this 0 average over two image updates by changing the phase of the hold/evolve waveform between 0 and 180 degrees on every image update. A 0-degree hold/evolve waveform begins high and halfway through its cycle changes to low. Conversely, a 180-degree hold/evolve waveform begins low and halfway through its cycle changes to high. As can be seen in FIG. 6, rows 1 and 3 develop a non-0 DC offset because the number of high half-cycles is not equal to the number of low half-cycles during the hold/evolve phases. Specifically, row 1 has three high half-cycles and two low half-cycles, and row 3 has four high half-cycles and three low half-cycles. On the next image update the phase of the hold/evolve waveform is changed 180 degrees so that row 1 will have two high half-cycles and three low half-cycles and row 3 will have three high half-cycles and four low half-cycles. Consequently, over two image updates a given row has an equal number of high and low half-cycles, and hence a 0 time-averaged voltage and 0 DC offset. Rows 0 and 2 naturally have 0 DC offset regardless of the phase of the hold/evolve waveform because the number of high half-cycles is always equal to the number of low half-cycles during the hold/evolve phases. Specifically, row 0 has two high half-cycles and two low half-cycles while row 2 has three high half-cycles and three low half-cycles.

Figure 9:
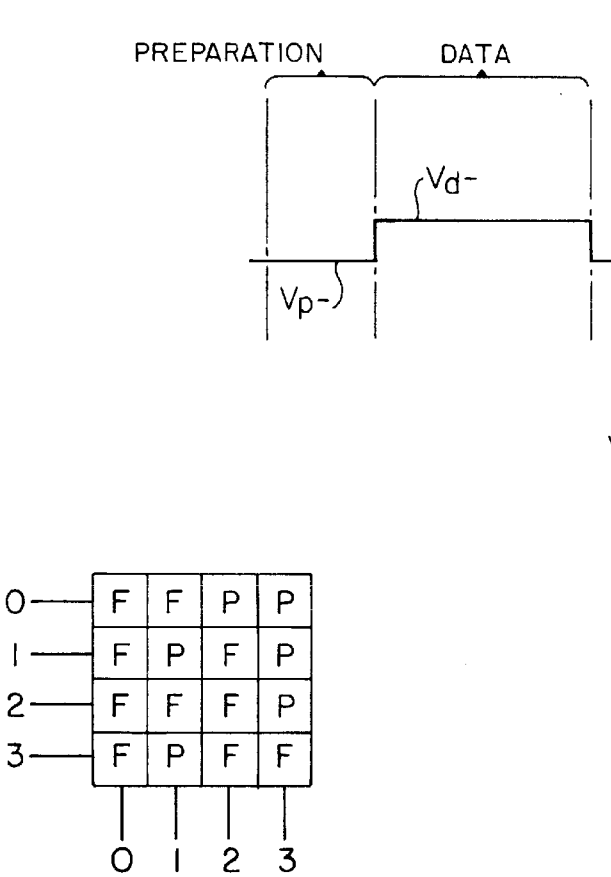
FIG. 9 is a four by four pixel display showing how such a display would appear according to the waveforms provided in FIGS. 6–8.

As seen in FIG. 9, the combination of the output waveforms in FIG. 8 with the output waveforms of either FIG. 6 or FIG. 7 forces the material into focal conic textures for all column 0 pixels. Column 1 pixels are all focal conic except for row 1. While in column 2, all the pixels are focal conic except for row 0. In column 3, all the pixels are planar except for row 3. After application of the data voltages necessary to generate an image, a pseudo data voltage waveform is applied to the column electrodes while the evolve/non-select phase is applied to the row electrodes.

When the scan mode is desired, the waveform fed to the superinput 58 is three-level ($V_{n/s}$, $V_{s+}$, $V_{s-}$) and performs either the row select function or the row non-select function. The duration of the evolution phase is the same for all rows and the image update has the following appearance. First, the entire display is black for the duration of the preparation time plus the evolution time occurring after the pixels in the first row are addressed. Upon completion of the evolution phase, the pixels in the first row relax into their final stable states. Likewise, all the pixels in the second row addressed relax into their final stable states. These steps are then repeated until the pixels in all the addressed rows have arrived into their final reflective planar or transparent focal conic textures. After the evolution of the final row addressed is complete, all rows and columns are taken to an equal potential resulting in the voltage across pixel being driven to 0.

The total amount of time for the image update can be determined by the following equation:

Scan mode update time=Preparation Time+(Row Select Time)*(Total Number of Rows)+Evolution time The minimum possible evolution time, given that all rows have equal select times is determined by:

Minimum Evolution Time=(Number of outputs per row chip−1)*(Row Select Time)

In the flash mode, the pixels in each row experience an evolution time that depends on when the row was addressed and hence on the total number of rows in the display. The waveform fed to the superinput 58 is only two-level and only performs the select function by applying $V_{s+}$ or $V_{s-}$. All rows evolve until the last row addressed receives the minimum evolve time necessary, which depends on the cholesteric liquid crystal material used. After the evolution of the final row addressed is complete, all rows and columns are taken to an equal potential resulting in the voltage across each pixel being driven to 0. Consequently, the image appears all at once on the display.

Flash mode addressing yields an image update with the following appearance. First, the whole display is black for the duration of the preparation time plus the row select time times the total number of rows plus the minimum evolution time. Next, the whole image appears on the display at once, with all planar pixels relaxing into their final reflective states simultaneously. The transparent focal conic pixels have already reached their final transparent stable states by the end of the evolution time and do not change their appearance.

Employing the segment and common drivers of the present invention, the following exemplary voltage values have been determined:

| Abbreviation | Description | Typical Value |
|---|---|---|
| $V_p+$ | Upper level Preparation waveform | 40 V |
| $V_p-$ | Lower level Preparation waveform | 0 V |
| $V_{h/e}+$ | Upper level Hold/Evolve waveform | 40 V |
| $V_{h/e}-$ | Lower level Hold/Evolve waveform | 4 V |
| $V_s+$ | Upper level Select waveform | 26 V |
| $V_s-$ | Lower level Select waveform | 18 V |
| $V_d+$ | Upper level Data waveform | 25 V |
| $V_d-$ | Lower level Data waveform | 19 V |
| $V_{n/s}$ | Row Non-Select voltage for Scan Mode | 22 V |

The relationship between these row and column waveform levels and the pixel voltage RMS values are as follows:

Preparation RMS Voltage:

$$V_{PREP}=V_p+ -V_p-$$

Hold/Evolve RMS Voltage:

$$V_{H/E}=[(V_{h/e}+ -V_d+)^2+(V_{h/e}+ -V_d-)^2+(V_{h/e}- -V_d+)^2+(V_{h/e}- -V_d-)^2]^{1/2}/2$$

$$V_{H/E}\cong V_{h/e}+ -V_{h/e}-$$

Planar Texture Select Phase RMS Voltage (Column Data out of phase with Row Select waveform):

$$V_{Planar}=[(V_s+ -V_d-)^2+(V_s- -V_d+)^2]^{1/2}/\mathrm{sqrt}(2)$$

Focal Conic Texture Select Phase RMS Voltage (Column Data in phase with Row Select waveform:

$$V_{Focal}=[(V_s+ -V_d+)^2+(V_s- -V_d-)^2]^{1/2}/\mathrm{sqrt}(2)$$

In order to guarantee no DC offset across all the pixels in the display over two image updates, the following rules must apply to the voltage levels:

| | |
|---|---|
| Then: | $V_s+ - V_{n/s} = V_{n/s} - V_s$<br>$V_d+ - V_{n/s} = V_{n/s} - V_d-$. |

Figure 10:
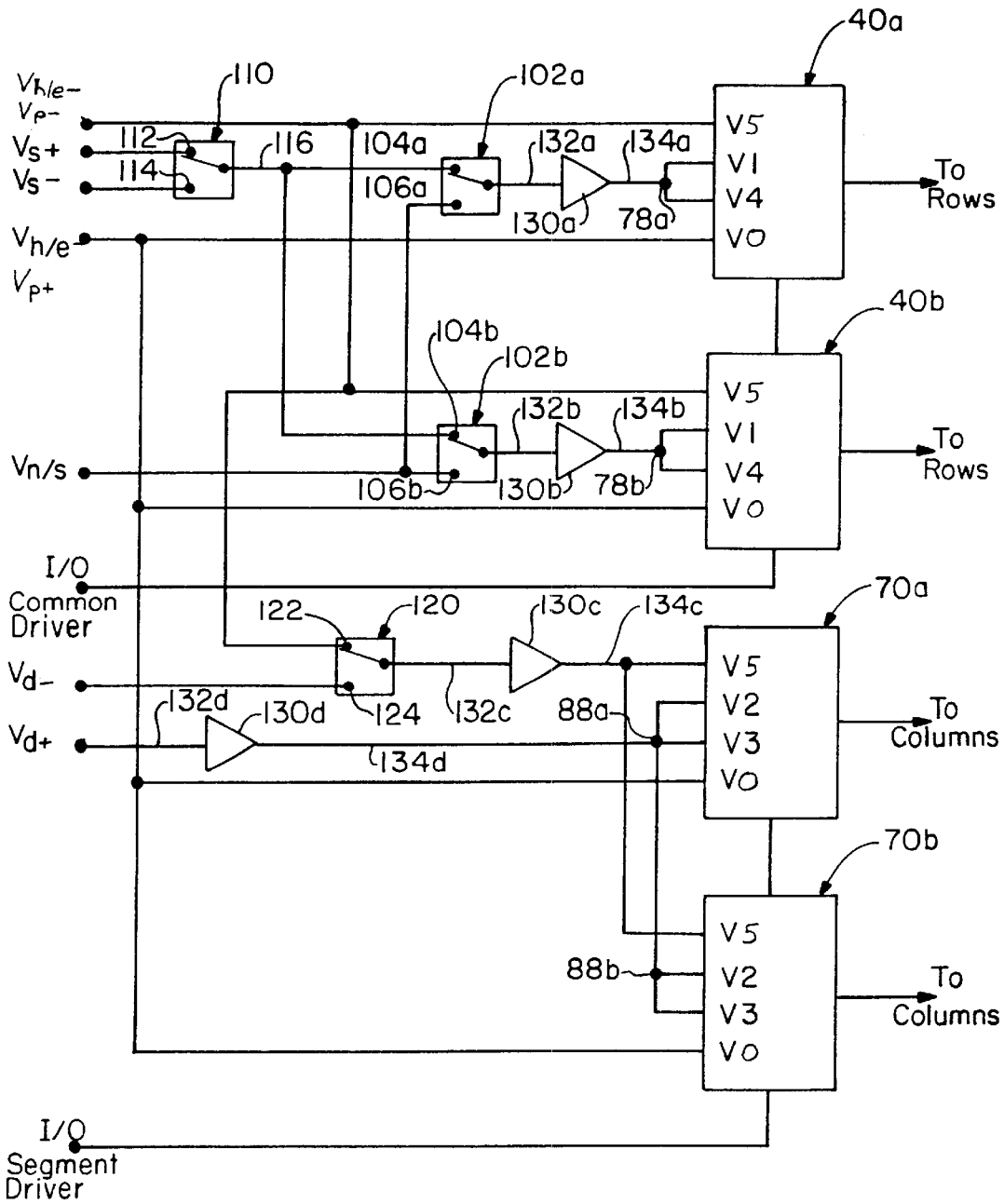
FIG. 10 is a block diagram according to the present invention showing both common and segment drivers.

Referring now to FIG. 10, it can be seen that a driving circuit block diagram is designated generally by the numeral 100. The driving circuit 100 includes a plurality of common drivers 40 and a plurality of segment drivers 70.

The circuit produces the common and segment driver input waveforms of FIGS. 6, 7, and 8. Take note that this block diagram is not meant to be an accurate representation the design or construction of the drive circuit. Rather, it is meant to be a representation of the logic of the drive circuit showing how the DC voltages may be routed to the common and segment drivers'display voltage inputs.

The voltages $V_{h/e+}$, $V_{h/e-}$, $V_{s+}$, $V_{s-}$, $V_{n/s}$, $V_{d+}$, and $V_{d-}$, are DC voltages whose values and relationships have been previously stated.

A plurality of buffers 130*a–d* are coupled to the drivers 40*a–b* and 70*a–b* and have voltage inputs 132 that are isolated from their voltage outputs 134 and thus serve to keep the voltages applied to the inputs 132 from varying when a load is applied to the outputs 134 (i.e., the buffer inputs are high impedance while the outputs are low impedance). The buffers 130 ensure that the proper voltage values are maintained throughout the drive circuit as the display is updated.

A pair of mode select switches 102*a–b* are connected to corresponding drivers 40*a–b* to determine in which mode the corresponding common driver operates, whether in the hold/select/evolve mode or the evolve/non-select mode. All mode select switches 102 are independent of each other and are ultimately controlled by the digital control circuit. When the mode select switch 102*a* is set to a high input 104*a*, the select common input waveform is routed to the input 132*a*, through the buffer 130*a*, and onto the common driver 40*a*. In particular, the buffer 130 generates an output 134 that is received by the superinput 78. When the switch 102*a* is set to the low input 106*a*, the input non-select DC voltage $V_{n/s}$ is routed to the input 132*a*, through the buffer 130*a*, and onto the common driver 40*a* in a like manner.

A common select waveform generator switch 110 creates the select common input waveform that has been previously described. It consists of a high input 112 connected to $V_{s+}$, a low input 114 connected to $V_{s-}$, and an output 116 connected to the high inputs 104 of the mode select switches 102. It is ultimately controlled by the digital control circuit. Toggling the common select waveform generator switch 110 between the high input 112 and the low input 114 generates the select common input waveform at the output 116 by alternately routing the voltages Vs+ and Vs– to the output 116.

A prep/write select switch 120 consists of a high input 122 connected to $V_{h/e-}$, a low input 124 connected to $V_{d+}$, and an output 126 connected to the buffer input 132*c*. It is ultimately controlled by the digital control circuit. During the preparation phase of an image update the prep/write switch 110 is set to the high input 122 and $V_{h/e-}$ is routed to the buffer 132 and on to the segment drivers. During the writing phase of an image update the prep/write switch 110 is set to the low input 124 and $V_{d-}$ is likewise routed to the buffer 132 and on to the segment drivers 70.

Although the superinputs 88 are used on the segment drivers in the current invention, it is not necessary. All that is necessary is that $V_3$ be less than or equal to $V_2$. The $V_3$ voltage input is never used with the current waveforms.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A bistable cholesteric liquid crystal display, comprising:

a pair of opposed substrates, one said substrate having a first plurality of electrodes, the other said substrate having a second plurality of electrodes oriented in a direction different than said first plurality of electrodes;

a cholesteric liquid crystal material disposed between said pair of opposed substrates and forming a pixel at each intersection of said first and second plurality of electrodes;

a first super twisted nematic driver having a plurality of outputs connected to said first plurality of electrodes; and a second super twisted nematic driver having a plurality of outputs connected to said second plurality of electrodes, wherein both said drivers receive a plurality of voltage waveforms for selective transmission as respective voltage output waveforms to said first and second plurality of electrodes.

2. The display according to claim 1, wherein said voltage output waveforms are combined to form a pixel waveform at each said pixel.

3. The display according to claim 2, wherein said pixel waveform comprises:

a preparation phase for applying a preparation voltage to each said pixel for driving said cholesteric liquid crystal material into a homeotropic texture;

a hold phase for applying a hold voltage, different than said preparation voltage, for maintaining said cholesteric liquid crystal material in the homeotropic texture;

a selection phase for applying a selection voltage to each said pixel for predisposing said cholesteric liquid crystal material; and an evolution phase for applying an evolution voltage to each said pixel to allow said predisposed liquid crystal material to relax into either a planar or a focal conic texture.

4. The display according to claim 1, wherein said plurality of voltage input waveforms applied to one of said drivers comprises an upper level and a lower level preparation waveform, an upper level and a lower level select waveform, and an upper and a lower level hold/evolve waveform.

5. The display according to claim 4, wherein said plurality of voltage input waveforms applied to one of said drivers comprises a non-select waveform.

6. The display according to claim 1, wherein said plurality of voltage input waveforms applied to one of said drivers comprises a lower level preparation voltage and an upper level and a lower level data waveform.

7. The display according to claim 1, wherein said voltage output waveforms applied to one of said plurality of electrodes comprises:

an alternating upper and lower level preparation waveform, an alternating upper and lower level select waveform, and an alternating upper and lower level hold/evolve waveform.

8. The display according to claim 7, wherein said voltage output waveforms applied to one of said plurality of electrodes further comprises a non-select waveform.

9. The display according to claim 1, wherein said voltage output waveforms applied to one of said plurality of electrodes comprises:

an alternating upper and lower level preparation waveform, and an alternating upper and lower level data waveform.

10. A method for addressing a cholesteric liquid crystal display which has a pair of opposed substrates, one of the substrates having a first plurality of electrodes, the other substrate having a second plurality of electrodes oriented in a direction different than the first plurality of electrodes, the substrates having cholesteric liquid crystal material disposed therebetween to form a pixel at each intersection of the first and the second plurality of electrodes, the first plurality of electrodes having at least a first driver coupled thereto and the second plurality of electrodes having at least a second driver coupled thereto, the method comprising the steps of:

applying a plurality of voltage input waveforms to the first driver and the second driver, wherein said voltage input waveforms are about 60 volts RMS or less;

selectively transmitting said plurality of voltage input waveforms through the first and the second drivers to generate respective first and second output waveforms;

combining said first and second output waveforms at the intersecting electrodes to generate a pixel waveform that drives the cholesteric liquid crystal material to the desired appearance, wherein said step of combining further comprises the steps of:

applying preparation voltages to each pixel for driving the cholesteric material into a homeotropic texture;

applying hold voltages to each pixel wherein at least one of said hold voltages is different than said preparation voltages, to maintain the cholesteric material in the homeotropic texture;

applying selection voltages to each pixel for predisposing the cholesteric material; and applying evolution voltages to each pixel to allow the predisposed cholesteric material to relax into either a planar or a focal conic texture.

11. The method according to claim 10, wherein said step of applying further comprises the steps of:

applying an upper level and a lower level preparation waveform;

applying an upper level and a lower level select waveform; and applying an upper level and a lower level hold/evolve waveform.

12. The method according to claim 11, wherein said step of applying further comprises the step of:

applying a non-select waveform.

13. The method according to claim 10, wherein said step of selectively transmitting further comprises the steps of:

transmitting upper and lower level preparation waveforms;

transmitting upper and lower level select waveforms; and transmitting upper and lower level hold/evolve waveforms.

14. The method according to claim 13, wherein said step of selectively transmitting further comprises the step of:

transmitting a non-select waveform.

15. The method according to claim 10, wherein said step of selectively transmitting further comprises the steps of:

transmitting upper and lower level preparation waveforms; and transmitting upper and lower level data waveforms.

16. A driving circuit for a reflective bistable cholesteric liquid crystal display which includes one substrate having a first plurality of electrodes opposed by another substrate having a second plurality of electrodes, wherein the intersection of the first and the second plurality of electrodes with bistable cholesteric liquid crystal material disposed therebetween form a plurality of pixels, the driving circuit selectively applying voltages to the first and the second plurality of electrodes to control the appearance of each pixel, the driving circuit comprising:

at least one common driver coupled to the first plurality of electrodes, each common driver having a first and a second common frame switch, each said common frame switch having a high input and a low input, said first and second frame switches linked to one another by a common frame line, said high and low inputs connected to a plurality of common data switches, each having a common output, said first common frame switch receiving a first and a second common voltage input and said second common frame switch receiving a third and a fourth common voltage input connected to each other, wherein said common frame line is toggled to selectively pass through said common voltage inputs for use as said common voltage output from each said common data switch; and at least one segment driver coupled to the second plurality of electrodes, said at least one segment driver having a plurality of segment voltage outputs which are selectively applied to the second plurality of electrodes to drive the cholesteric liquid crystal material to a desired texture.

17. The driving circuit according to claim 16, wherein said at least one segment driver has a first and a second segment firmed switch, each said segment frame switch having a high input and a low input, said first and second segment frame switches linked to one another by a segment frame line, said high and low segment inputs connected to a plurality of segment data switches, each segment data switch having a segment output, said first segment frame switch receiving a first and a second segment voltage input and said second segment frame switch receiving a third and a fourth segment voltage input connected to each other, wherein said segment frame line is toggled to selectively pass through said segment voltage inputs for use as said segment voltage output.

18. The driving circuit according to claim 17, wherein said third and fourth common voltage inputs provide a first arbitrary waveform for said corresponding common voltage output, and wherein said third and fourth segment voltage inputs provide a second arbitrary waveform for said corresponding segment voltage output.

19. The driving circuit according to claim 18, wherein said first common frame switch receives a preparation voltage and a hold/evolve voltage.

20. The driving circuit according to claim 18, wherein said first segment frame switch receives a preparation voltage and a data voltage.

21. The driving circuit according to claim 18, wherein said second common frame switch receives at least a selection voltage.

22. The driving circuit according to claim 18, wherein said second segment frame switch receives a data voltage.

23. The driving circuit according to claim 18, wherein said second row frame switch receives three different voltage values so that indicia appears on the display row by row.

24. The driving circuit according to claim 18, wherein said second common frame switch receives two different voltage values so that indicia appears on the display all at once.

25. A method for addressing a liquid crystal display having a plurality of common electrodes orthogonally positioned with respect to a plurality of segment electrodes with cholesteric liquid crystal material disposed therebetween, the method comprising the steps of:

connecting at least one common driver to the plurality of common electrodes;

connecting at least one segment driver to the plurality of segment electrodes; and toggling a pair of frame switches in each said common and segment driver such that a first of said pair of frame switches applies one of two waveforms to the corresponding electrodes or such that a second of said pair of frame switches applies an arbitrary waveform to the corresponding electrodes.

26. The method according to claim 25, other comprising the step of:

switching a plurality of data switches in each said common and segment driver to apply either the one of two waveforms or said arbitrary waveform to the corresponding electrodes.

27. The method according to claim 26 further comprising the step of:

transmitting a preparation voltage and a hold/evolve voltage through said first frame switch of said common driver.

28. The method according to claim 26 further comprising the step of:

transmitting a preparation voltage or a data voltage through said first frame switch of said segment driver.

29. The method according to claim 26, further comprising the step of:

transmitting at least a selection voltage through said second frame switch of said common driver.

30. The method according to claim 26, further comprising the step of:

transmitting a data voltage through said second frame switch of said segment driver.

31. The method according to claim, 26, further comprising the step of:

transmitting three different voltage values through said second frame switch of said common driver so that indicia appears on the display row by row.

32. The method according to claim 26, further comprising the step of:

transmitting two different voltage values through said second frame switch of said common driver so that indicia appears on the display all at once.

33. A driving circuit for a reflective bistable cholesteric liquid crystal display which includes one substrate having a first plurality of electrodes opposed by another substrate having a second plurality of electrodes, wherein the intersection of the first and the second plurality of electrodes with bistable cholesteric liquid crystal material disposed therebetween form a plurality of pixels, the driving circuit selectively applying voltages to the first and the second plurality of electrodes to control the appearance of each pixel, the driving circuit comprising:

a plurality of common drivers for generating and selectively applying voltages to the first plurality of electrodes, each said common driver having two inputs connected to each other to form a superinput;

a plurality of segment drivers for generating and selectively applying voltages to the second plurality of electrodes; and a mode select switch coupled to each said common driver to select one of two modes to transfer a select or non-select voltage to said superinput, wherein said plurality of common drivers and said plurality of segment drives apply the voltages to drive the cholesteric liquid crystal material to a desired texture.

34. The driving circuit according to claim 33, further comprising:

a common select waveform generator switch coupled to said mode select switch for generating said select voltage in a high value or a low value.

35. The driving circuit according to claim 33, further comprising:

a prep/write select switch coupled to said plurality of segment drivers to pass through a preparation signal when said switch is in a first position and a writing signal when said switch is in a second position.

* * * * *

UNITED STATES PATENT AND TRADEMARK OFFICE

CERTIFICATE OF CORRECTION

PATENT NO. : 6,278,429 B1
DATED : August 21, 2001
INVENTOR(S) : Jonathan C. Ruth, Richard Hewitt and Philip J. Bos It is certified that error appears in the above-identified patent and that said Letters Patent is hereby corrected as shown below:

Column 16, claim 17,
Line 29, the word "firmed" should be -- frame --.

Column 17, claim 26,
Line 13, the word "other" should be -- further --.

Column 17, claim 31,
Line 37, there should be no comma after the word "claim".

Signed and Sealed this

Ninth Day of April, 2002

*Attest:*

*Attesting Officer*

JAMES E. ROGAN
*Director of the United States Patent and Trademark Office*